US011575224B2

(12) United States Patent
Nishijima

(10) Patent No.: US 11,575,224 B2
(45) **Date of Patent: *Feb. 7, 2023**

(54) TERMINAL MODULE

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventor: Seido Nishijima, Mie (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 7 days.

This patent is subject to a terminal disclaimer.

(21) Appl. No.: 17/232,347

(22) Filed: Apr. 16, 2021

(65) Prior Publication Data

US 2021/0234296 A1 Jul. 29, 2021

Related U.S. Application Data

(63) Continuation of application No. 16/615,385, filed as application No. PCT/JP2018/018490 on May 14, 2018, now Pat. No. 11,005,203.

(30) Foreign Application Priority Data

May 26, 2017 (JP) ..... 2017-104348

(51) Int. Cl.
*H01R 13/08* (2006.01)
*H01R 13/24* (2006.01)
(Continued)

(52) U.S. Cl.
CPC ..... *H01R 13/08* (2013.01); *H01R 13/2421* (2013.01); *H01R 4/4863* (2013.01); *H01R 13/187* (2013.01)

(58) Field of Classification Search
CPC ..... H01R 2201/26; H01R 13/502; H01R 13/187; H01R 11/12; H01R 13/2421; H01R 4/4872; H01R 4/4863
See application file for complete search history.

(56) References Cited

U.S. PATENT DOCUMENTS

| | | | | |
|---|---|---|---|---|
| 10,305,214 | B2 | 5/2019 | Kimura et al. | |
| 10,418,740 | B2 | 9/2019 | Kimura et al. | |
| 11,005,203 | B2 * | 5/2021 | Nishijima | H01R 13/08 |

FOREIGN PATENT DOCUMENTS

| | | | |
|---|---|---|---|
| JP | 2000268903 A | * | 9/2000 |
| JP | 2002-274290 | | 9/2002 |

(Continued)

OTHER PUBLICATIONS

Machine Translation of JP 2000-268903.*
International Search Report dated Jun. 12, 2018.

*Primary Examiner* — Oscar C Jimenez
*Assistant Examiner* — Paul D Baillargeon
(74) *Attorney, Agent, or Firm* — Gerald E. Hespos; Michael J. Porco

(57) ABSTRACT

A terminal module (10) has a metal case (20) with a ceiling wall (21), a bottom wall (51) facing the ceiling wall (21), opposed side walls (23) extending from the ceiling wall (21) toward the bottom wall (51) and retaining pieces (24). A coil spring (40) is sandwiched between the ceiling wall (21) and the bottom wall (51). The retaining pieces (24) face each other in a direction perpendicular to a facing direction of the side walls (23) and project toward the bottom wall (51) from the periphery of the ceiling wall (21). The side walls (23) and the retaining pieces (24) are disposed alternately on the periphery of the ceiling wall (21). A spring receiving portion (26) formed by the ceiling wall (21), the side walls (23) and the retaining pieces (24) receives an end part of the coil spring (40) on the side of the ceiling wall (21).

7 Claims, 11 Drawing Sheets

(51) Int. Cl.
*H01R 13/187* (2006.01)
*H01R 4/48* (2006.01)

(56) References Cited

FOREIGN PATENT DOCUMENTS

| | | |
|---|---|---|
| JP | 5761510 | 8/2015 |
| JP | 2017-84752 | 5/2017 |

* cited by examiner

TERMINAL MODULE

The present application is a continuation application of U.S. patent application Ser. No. 16/615,385, filed Nov. 20, 2019, the contents of which are hereby incorporated by reference in their entirety.

BACKGROUND

Field of the Invention

This specification relates to a terminal module.

Related Art

A method for electrical connection is known by which contact points facing each other butt into contact, for example, in establishing an electrical connection in an automotive vehicle or the like. However, a conduction failure occurs in such a method, if an external matter adheres between the contact points, a conduction failure occurs.

Japanese Unexamined Patent Publication No. 2002-274290 discloses a power supply device that removes external matter from both contact points by sliding the contact points against each other when butting the contact points against each other. Specifically, the power supply device of Japanese Unexamined Patent Publication No. 2002-274290 has a female junction with end plates facing the inside of a case and a coil spring sandwiched and compressed between these end plates. The end plate on a side exposed to the outside has a resilient leaf spring. This leaf spring is provided with an easily resiliently deformable and oblique free end part by being bent after extending outward from the end plate. A male-side contact point and a female-side contact point (free end part) slide against each other when contacting each other, and this sliding action removes external matter between the contact points is removed.

However, the above configuration is not an option when a large current is used. More particularly, the leaf spring must be thick to enhance rigidity when a large current is used, and the pressing force from the thick rigid leaf spring may deform or break the end plate made of an insulating material.

SUMMARY

A terminal module disclosed by this specification has a case made of metal and including a ceiling wall, a bottom wall, two side walls and two retaining pieces. A coil spring is sandwiched between the ceiling wall and the bottom wall. The ceiling wall and the bottom wall face each other. Additionally, the side walls project toward the bottom wall from peripheral sides of the ceiling wall while facing each other. The retaining pieces face each other in a direction perpendicular to a facing direction of the side walls and project toward the bottom wall from the peripheral sides of the ceiling wall while facing each other. The side walls and the retaining pieces are alternately disposed on the peripheral sides of the ceiling wall so that a spring receiving portion for receiving an end part of the coil spring on the ceiling wall side is constituted by the ceiling wall, the side walls and the retaining pieces. With this configuration, the case made of metal is provided with the spring receiving portion for receiving the end part of the coil spring. The spring receiving portion is not deformed or broken by being pressed by the coil spring, and the terminal module can be applied when a large current is used.

A method for fixing a guiding bar to a ceiling wall of a case and inserting the guiding bar into a coil spring may be attempted for supporting the coil spring. However, the component cost of the guiding bar and crimping cost for crimping and fixing the guiding bar to the case would have to be incurred. Thus, the cost of a terminal module would increase. However, according to the invention, the component cost of the guiding bar and processing cost for fixing the guiding bar to the case are not incurred.

The bottom wall may constitute an electrical contact to be connected electrically to a mating contact point and may be movable between an initial position where the bottom wall is supported by supports on the side walls and a connection position where the bottom wall is displaced toward the ceiling wall by being connected to the mating contact point. The bottom wall at the connection position may be disposed closer to the supports than projecting ends of the retaining pieces. According to this configuration, when the bottom wall is connected electrically to the mating contact point, the bottom wall is displaced from the initial position toward the ceiling wall to reach the connection position. However, the bottom wall is closer to the supports than the projecting ends of the retaining pieces. Thus, the bottom wall does not interfere with the projecting ends of the retaining pieces.

The retaining piece may be composed of a base end and a flat surface. The base end may bulge out of the case from the peripheral edge of the ceiling wall by being disposed between two cutouts provided on the peripheral edge of the ceiling wall. The flat surface may extend straight toward the bottom wall from the base end and may constitute part of the spring receiving portion. According to this configuration, a clearance formed between the coil spring and the retaining piece can be made smaller as compared to the case where the retaining piece is provided with no flat surface.

The side wall may include a struck portion formed by being struck inwardly of the case and constituting the spring receiving portion. According to this configuration, a clearance formed between the coil spring and the side wall can be made smaller as compared to the case where the side wall has no struck portion.

According to the teaching of this specification, it is possible to reduce cost for a terminal module for a large current use.

DETAILED DESCRIPTION

Figure 10:
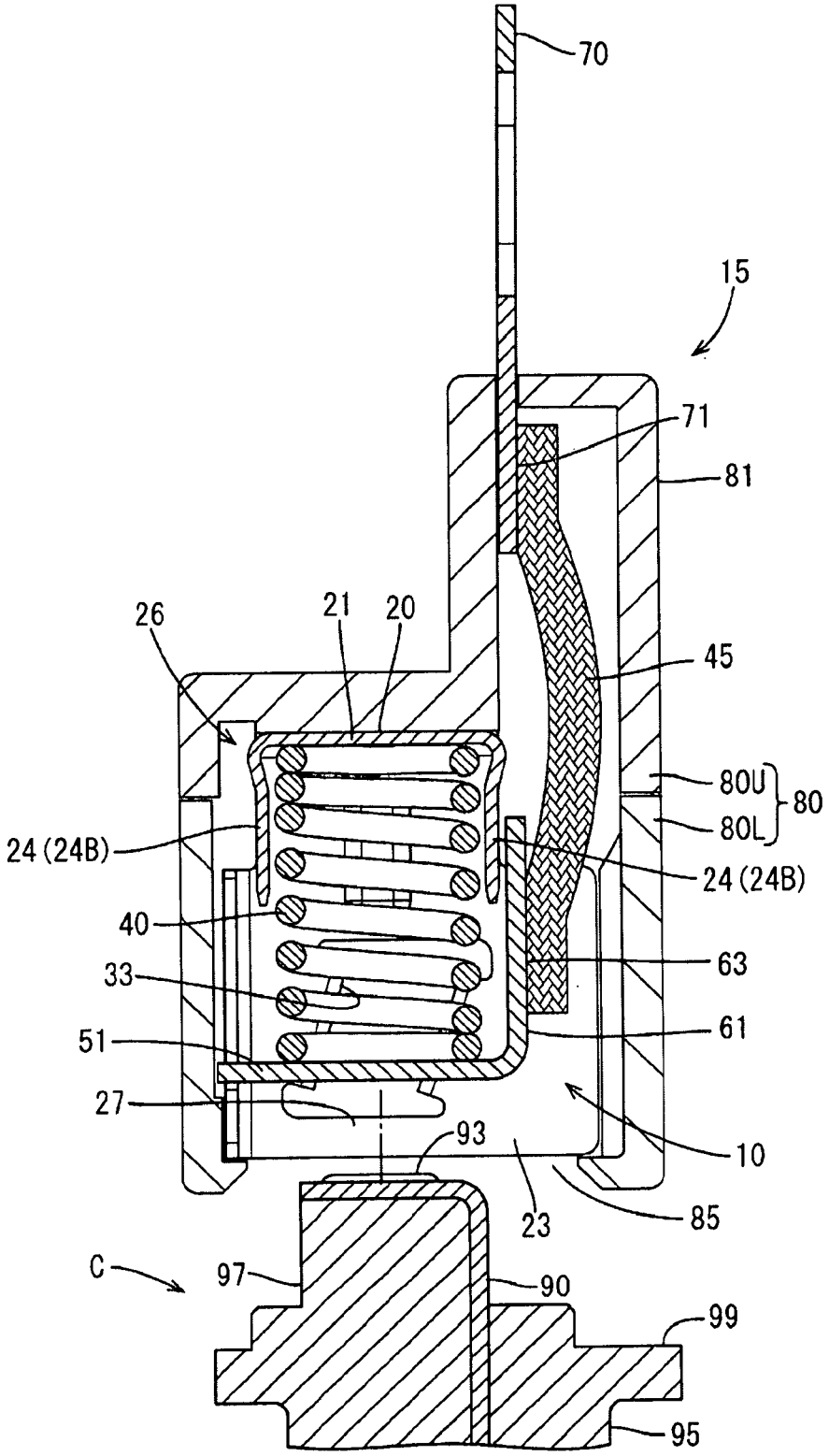
FIG. 10 is a section showing a state before a connector is connected to a mating connector.

An embodiment is described with reference to FIGS. 1 to 11. A terminal module 10 of this embodiment is connected electrically to a mating terminal 90 by being butted against the mating terminal 90. In the following description, an upper side in FIG. 10 is referred to as an upper side and a lower side (side of the mating terminal 90) in FIG. 10 is referred to as a lower side. Further, a left side in FIG. 3 is referred to as a front and a right side (side of a braided wire 45) in FIG. 3 is referred to as a rear.

Figure 1:
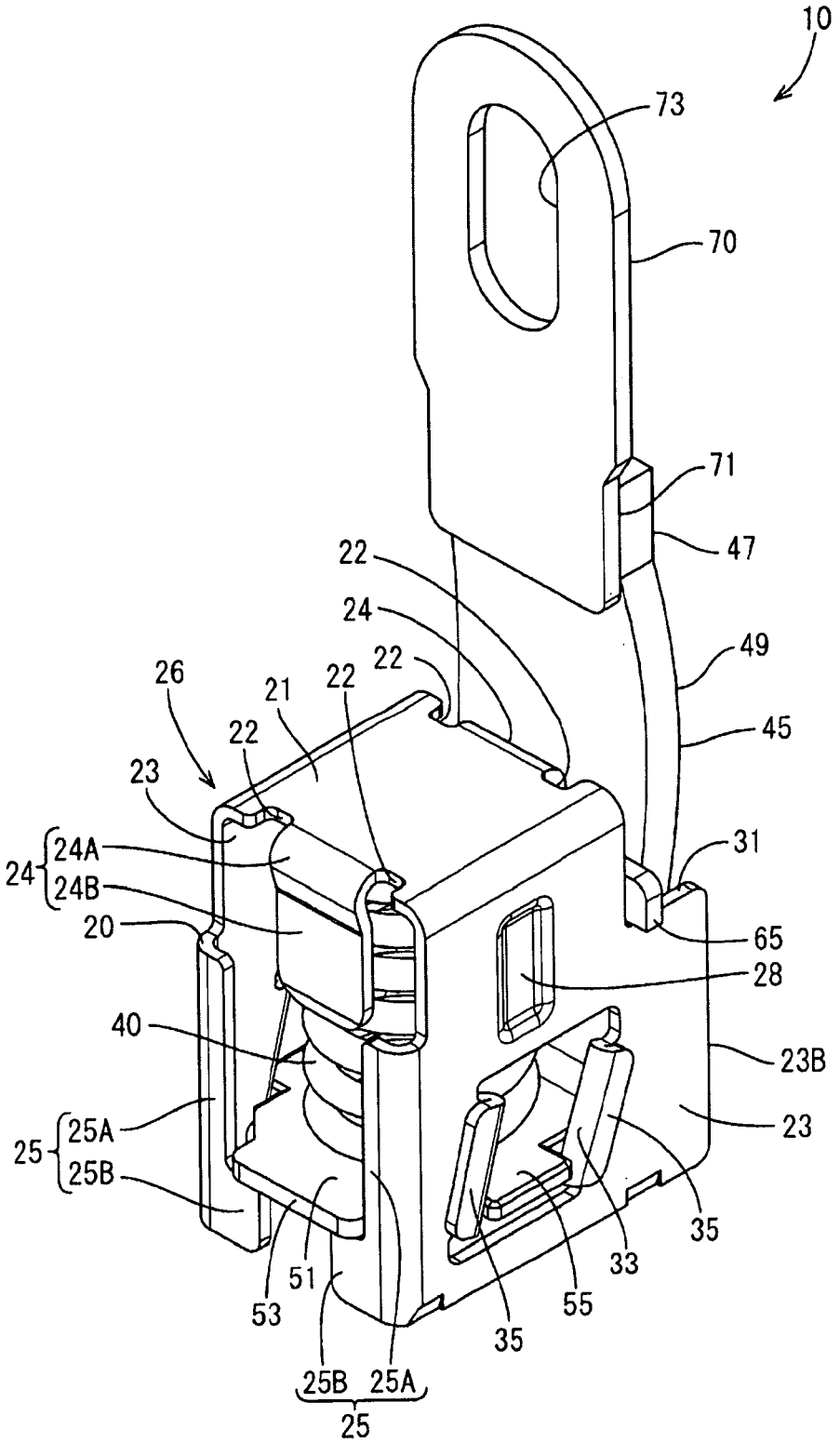
FIG. 1 is a perspective view of a terminal module in an embodiment.

The terminal module 10 of this embodiment includes, as shown in FIG. 1, a case 20 and a coil spring 40 accommodated in a compressed state inside the case 20. The case 20 includes an electrical contact 50 biased toward an opening 27 of the case 20 by the coil spring 40, and this electrical contact 50 is connected conductively to an external connecting member 70 via the braided wire 45.

Figure 2:
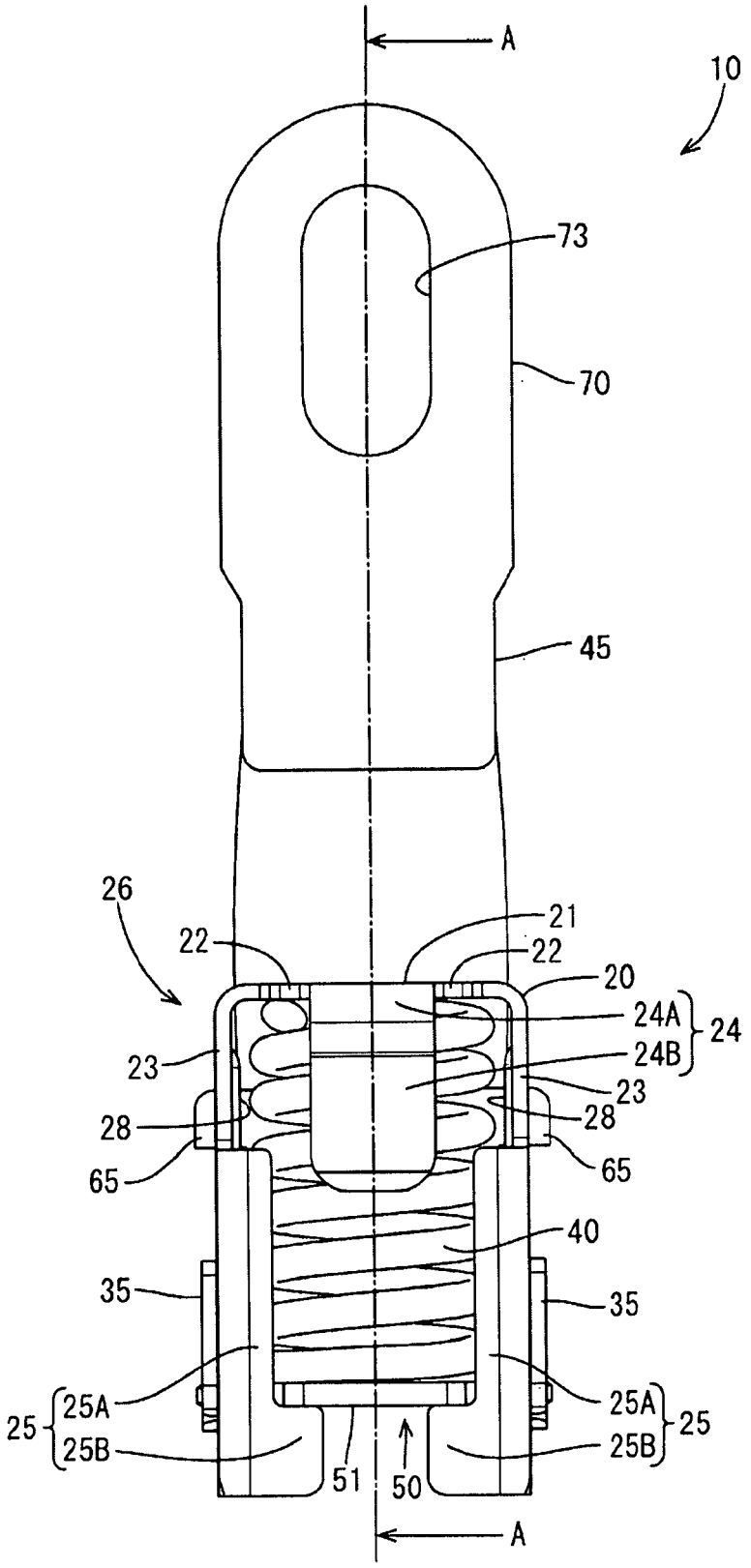
FIG. 2 is a front view of the terminal module.

As shown in FIGS. 1 and 2, the case 20 includes a ceiling wall 21, left and right side walls 23 extending down from opposite sides of the ceiling wall 21, facing each other and parallel to each other, a pair of front walls 25 bent at a right angle and extending from the front ends of lower end parts of the side walls 23, and the electrical contact 50. A box constituted by the ceiling wall 21, the left and right side walls 23 and the front walls 25 of the case 20 is formed by press-working a metal plate material such as a SUS material and is open in a front-rear direction and downward. An opening 27 on a lower side can receive the mating terminal 90. The electrical contact 50 is disposed on a back side (upper side) of the opening 27.

Figure 3:
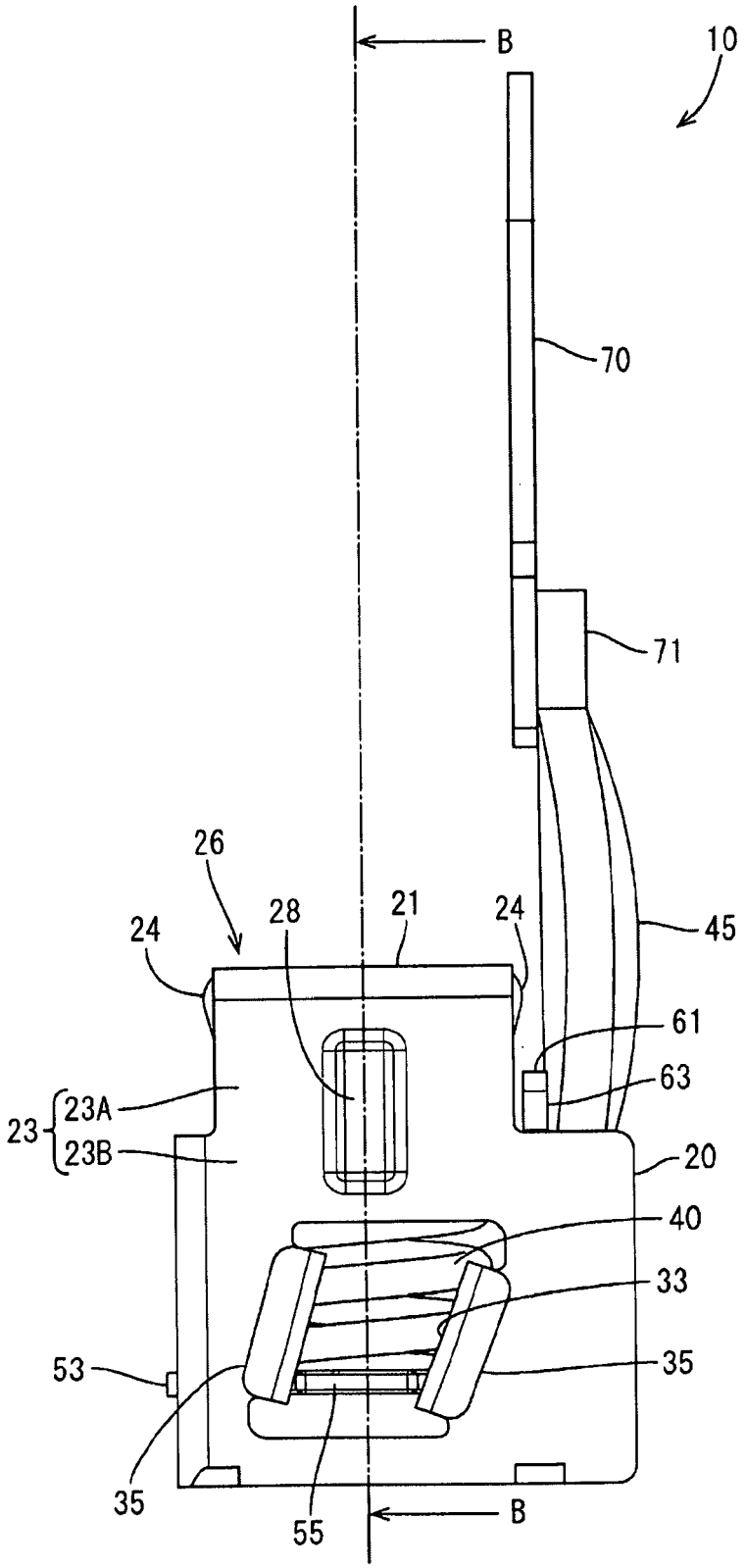
FIG. 3 is a side view of the terminal module.
Figure 4:
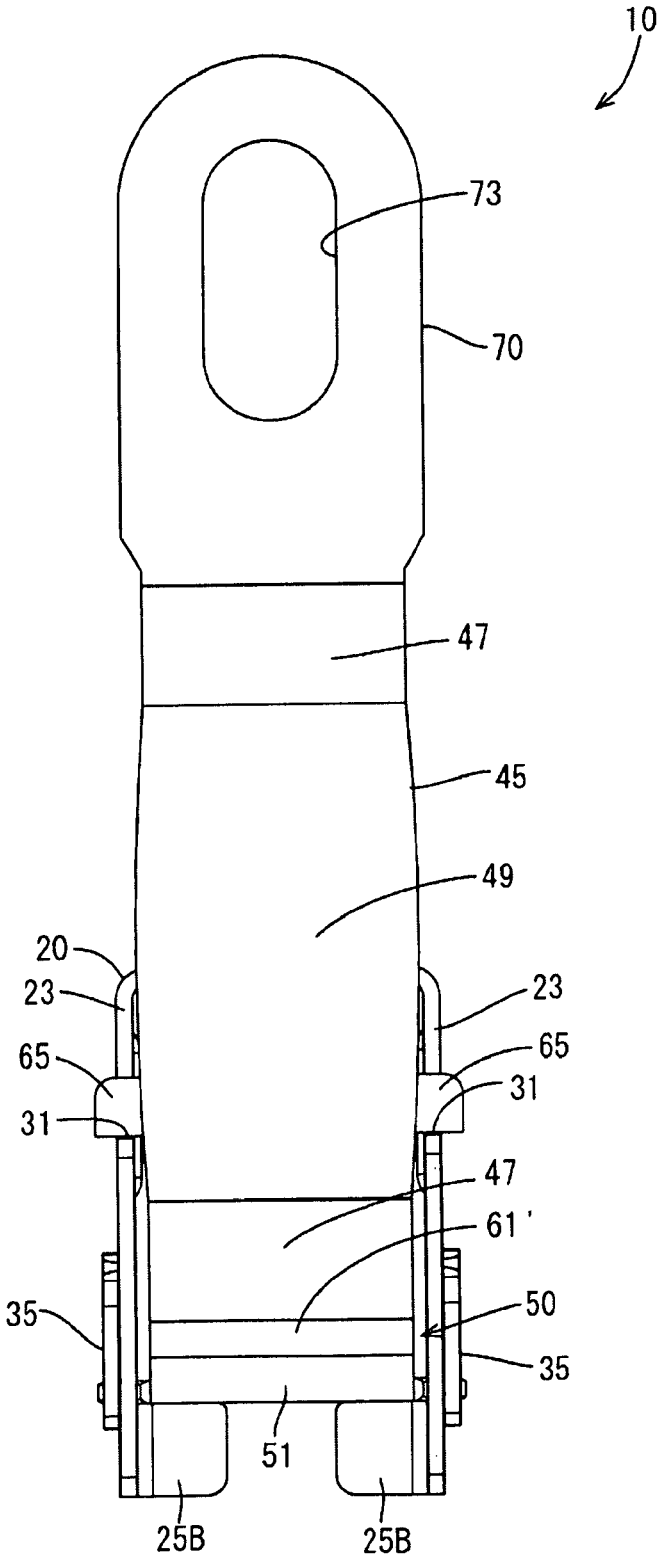
FIG. 4 is a back view of the terminal module.
Figure 5:
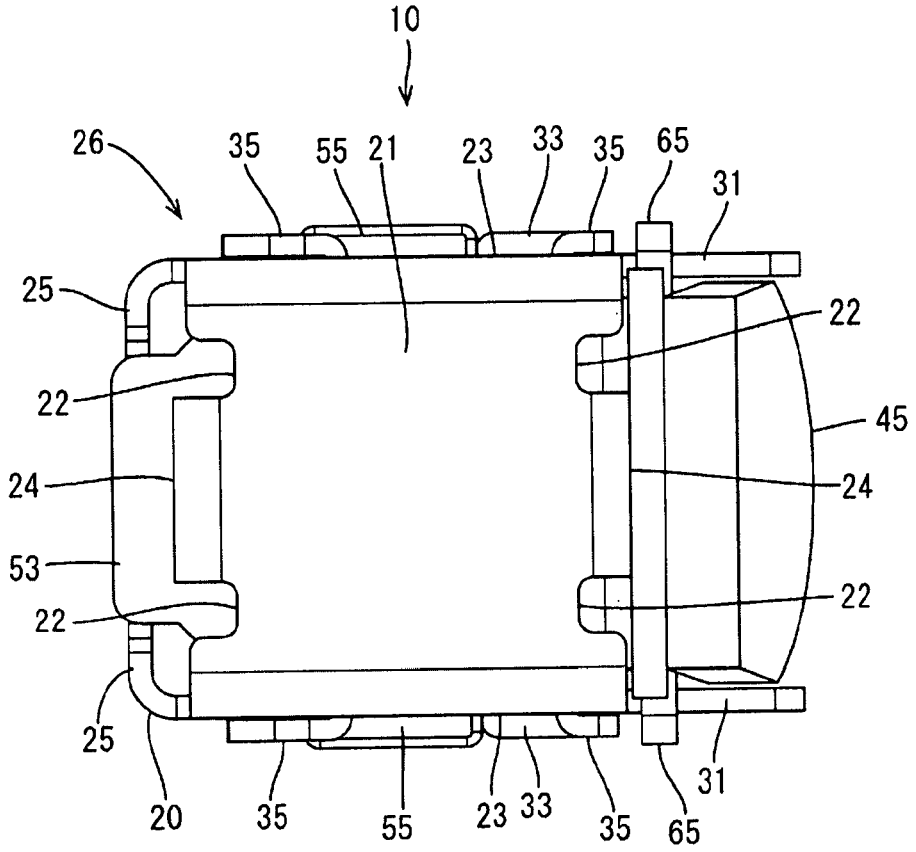
FIG. 5 is a plan view of the terminal module.
Figure 6:
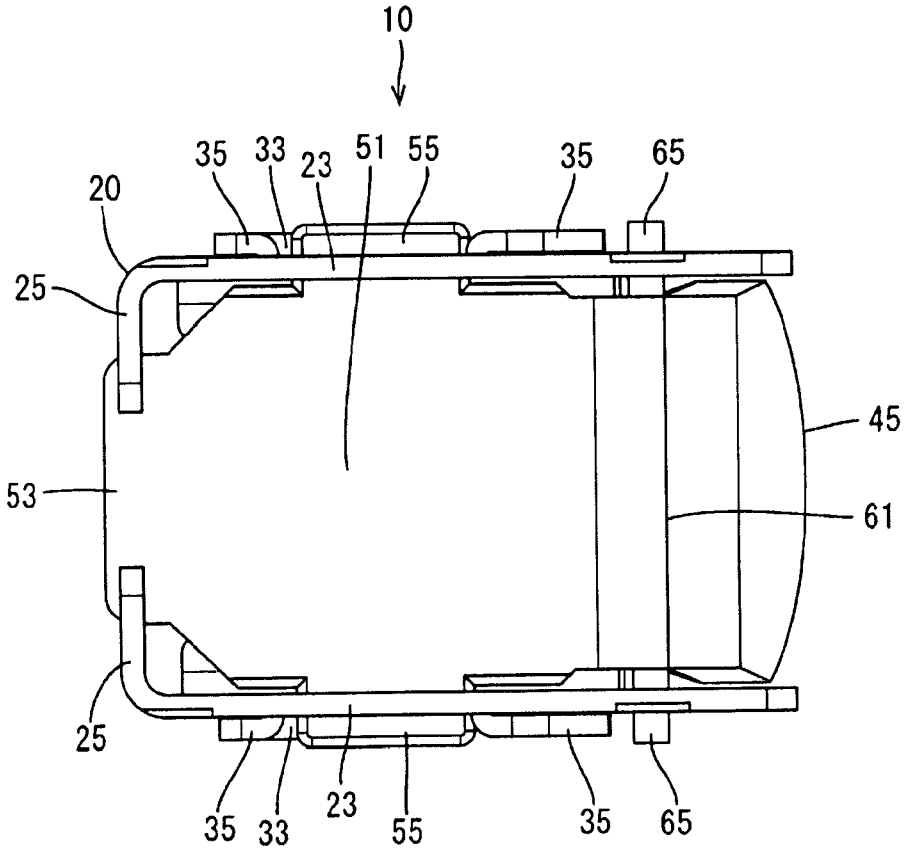
FIG. 6 is a bottom view of the terminal module.

As shown in FIGS. 1 and 3, each side wall 23 is composed of an upper end portion 23A rectangular in a side view and a lower end portion 23B rectangular in the side view, and is shaped such that the rear end of the lower end portion 23B projects farther rearward than the rear end of the upper end portion 23A. A dimension of the upper end portion 23A of the side wall 23 in the front-rear direction is slightly larger than an outer dimension of the coil spring 40 and is equal to a dimension of the ceiling wall 21 in the front-rear direction. On the other hand, a dimension of the lower end portion 23B in the front-rear direction is larger than the dimension of the upper end portion 23A in the front-rear direction by a dimension of a connecting part of a later-described connecting piece 61 of the electrical contact 50 and the braided wire 45. The upper surface of a rear end part of the lower end portion 23B serves as a contact 31 that contacts later-described positioning portions 65 of the electrical contact member 50.

The lower end 23B of the side wall 23 is provided with a guide 33. The guide 33 is an inner wall of a through hole provided in the side wall 23, and the position of an upper end part of the guide 33 is shifted more rearward (lateral shifting direction with respect to an entering direction of the mating terminal 90) than the position of a lower end part of the guide 33. Thus, front and rear end parts are oblique. That is, the front and rear end parts of the guide 33 are parallel to each other and extend straight in a direction oblique to the entering direction of the mating terminal 90. Second protruding portions 55 of the electrical contact member 50 slide in contact with the front parts of the guides 33, whereby the electrical contact 50 also moves rearward when moving upward.

Folded portions 35 are provided on both front and rear end parts of the guide 33. The folded portions 35 are folded outward by 180° to overlap on the outer surface of the side wall 23. Note that the guide 33 slides in contact with the second protruding portion 55 at positions where the folded portions 35 are provided. Long holes having a larger dimension in the front-rear direction than an interval between the folded portions 35 are provided on both upper and lower sides of the folded portions 35.

As shown in FIGS. 1 and 2, the front wall 25 is formed by being bent at a right angle from the front edge of the lower end portion 23B of one side wall 23 toward the front edge of the other side wall 23, and is composed of a narrow portion 25A and a wide portion 25B. A dimension between the narrow portions 25A is equal to or somewhat larger than a width (lateral dimension) of a first protruding portion 53 of the electrical contact 50, and the first protruding portion 53 is movable in a vertical direction. On the other hand, a dimension between the two wide portions 25B is smaller than the dimension between the two narrow portions 25A. Thus, the lower surface of the first protruding portion 53 contacts upper parts of the wide portions 25B so that the first protruding portion 53 (bottom wall 51) is supported by the wide portions 25B without falling down from the wide portions 25B. Note that the upper ends of the wide portions 25B are slightly higher than the lower ends of the folded portions 35 of the guides 33 so that the second protruding portions 55 are not located below the folded portions 35 of the guide portions 33 with the first guide 53 supported by the two wide portions 25B.

Figure 7:
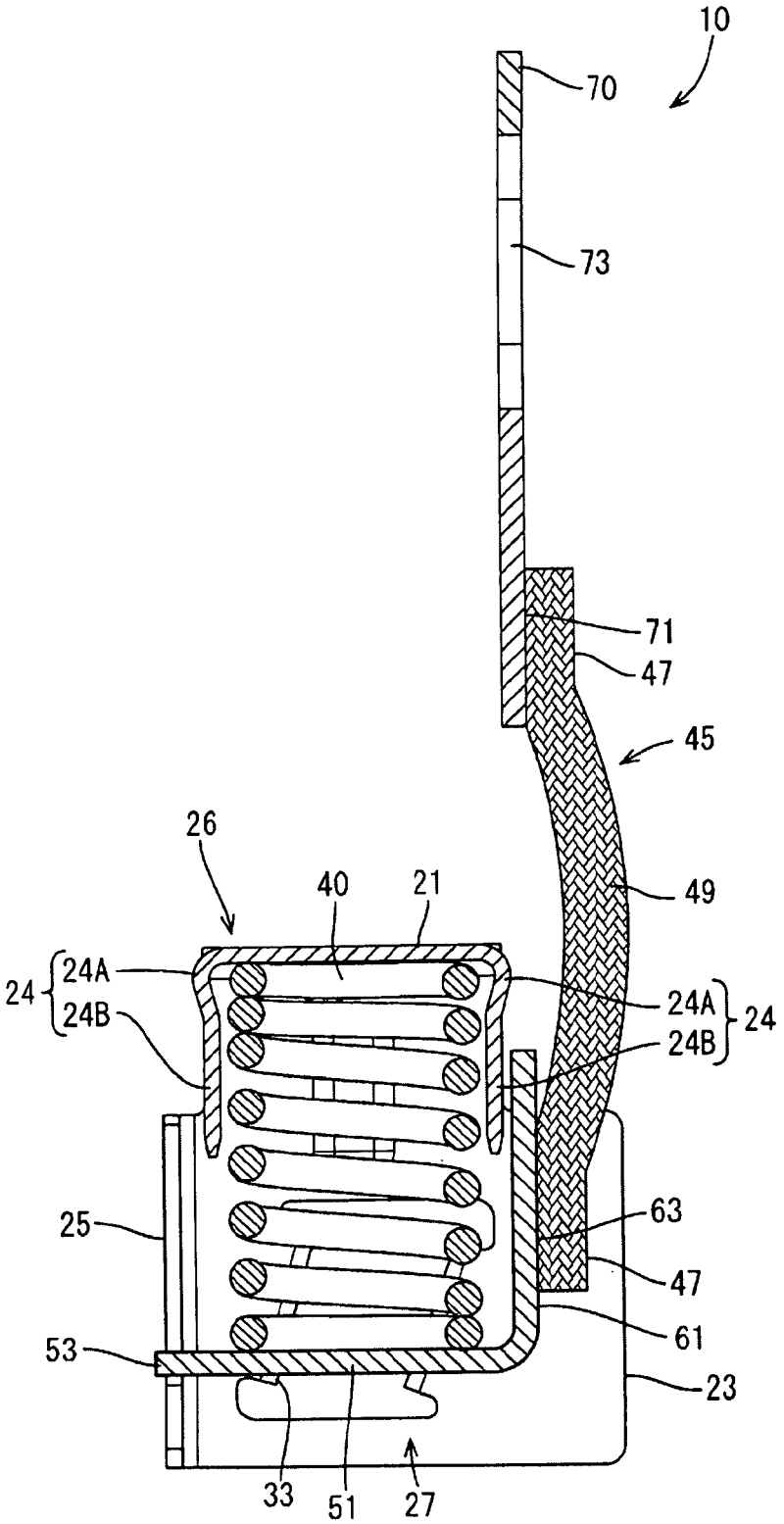
FIG. 7 is a section along A-A in FIG. 2.

As shown in FIGS. 1 and 7, the coil spring 40 is formed by winding a metal wire material made of SUS or the like into a coil, and is sandwiched in a compressed state by the ceiling wall 21 and the bottom wall 51 of the electrical contact 50. Upper and lower ends of the coil spring 40 bias the ceiling wall 21 and the bottom wall 51 of the electrical contact 50 while sections thereof substantially corresponding to one turn in a winding direction held in contact with the ceiling wall 21 and the bottom wall 51. The electrical contact 50 is biased down by a biasing force of the coil spring 40, and the lower surface of the first protruding portion 53 is pressed against the two wide portions 25B. In this way, the bottom wall 51 of the electrical contact 50 is sandwiched between the two wide portions 25B and the lower end part of the coil spring 40.

The electrical contact 50 is formed by press-working a metal plate material made of copper alloy or the like. The electrical contact 50 includes the bottom wall 51 arranged to face the ceiling wall 21 of the case 20 and a connecting piece 61 formed by being bent at a rear part of the bottom wall 51 to form an L-shape in a side view. Further, a plate thickness of the electrical contact 50 is set according to a current capacity required for the terminal module 10 and has a rigidity so as not be deformed by the biasing force of the coil spring 40. Note that the plate thickness of the electrical contact 50 is larger than a plate thickness of the ceiling wall 21 and the side walls 23 of the case 20.

The bottom wall 51 is a flat plate rectangular in a plan view, and the lower surface thereof serves as a contact surface that contacts mating contact points 93. The bottom wall 51 is exposed to the outside of the case 20 through the opening 27. The upper surface of the bottom wall 51 serves as a spring receiving surface for receiving the lower end of the coil spring 40. A dimension of the bottom wall 51 in the front-rear direction is larger than the dimension of the coil spring 40 in the front-rear direction and somewhat larger than the dimension of the ceiling wall 21 in the front-rear direction.

As shown in FIGS. 1 and 3, the first protruding portion 53 protrudes forward on the front of the bottom wall 51. The first protruding portion 53 is disposed between the two narrow portions 25A of the front walls 25. An end part of the first protruding portion 53 projects farther forward than the front walls 25. Further, two the second protruding portions 55 protrude left and right on both left and right sides of the bottom wall 51. The second protruding portions 55 are inserted into the guides 33 and end parts of the second protruding portions 55 project farther out than the outer side surfaces of the folded portions 35. A dimension of the second protruding portions 55 in the front-rear direction is equal to or somewhat smaller than a dimension of the guides 33 at the lower ends in the front-rear direction.

As shown in FIGS. 1 and 7, the connecting piece 61 is formed by being bent up at a right angle from the rear edge of the bottom wall 51. The rear surface (surface distant from the coil spring 40) of the connecting piece 61 serves as a connection surface 63 to which the braided wire 45 is connected. Two of the positioning portions 65 are provided on an upper part of the connecting piece 61 and contact with the contact portions 31 of the case 20 for positioning the connecting piece 61 to prevent a downward movement. The positioning portions 65 project farther out than the outer side surfaces of the side walls 23.

As shown in FIGS. 1 and 7, an external connecting member 70 is formed by press-working a metal plate material made of copper alloy or the like, and is in the form of a flat plate. The external connecting member 70 is disposed outside the case 20, and extends vertically (rising direction of the connecting piece 61). Further, the external connecting member 70 is provided with an external connection surface 71 to which the braided wire 45 is connected, and also has a long bolt hole 73.

The braided wire 45 is formed by braiding metal strands made of conductive copper or the like. As shown in FIG. 7, both end portions 47 of the braided wire 45 are connected to the connection surface 63 of the connecting piece 61 and the external connection surface 71 of the external connecting member 70 by resistance welding. Each end portion 47 has a slightly enhanced rigidity due to the resistance welding. An intermediate part 49 between the end portions 47 of the braided wire 45 is straight while having a slight extra length. If the electrical contact member 50 and the external connecting member 70 relatively move, the intermediate part 49 is deflected and deformed. Thus, when the electrical contact member 50 moves toward the external connecting member 70, the braided wire 45 is deflected and deformed to allow the electrical contact member 50 to move freely.

The terminal module 10 is accommodated inside a connector housing 80, as shown in FIG. 10. The connector housing 80 is configured by assembling vertically divided upper divided body 80U and lower divided body 80L made of synthetic resin. A connector 15 is constituted by the terminal module 10 and the connector housing 80.

The upper divided body 80U of the connector housing 80 is such that a rear end part of an upper wall protrudes upward and that protruding part serves as a lead-out portion 81 in which the external connection surface 71 of the external connecting member 70 is accommodated. Further, the lower divided body 80L is provided with a housing opening 85 allowing the entrance of the mating terminal 90. The housing opening 85 is provided substantially at the same position as the opening 27 of the terminal module 10, enables the electrical contact member 50 to be exposed downward and enables the entrance of a fitting 97.

A mating connector C to be connected to the connector 15 includes the mating terminal 90 and a mating housing 95 made of synthetic resin. As shown in FIG. 10, the mating terminal 90 is formed of conductive metal, and is formed into a substantially L shape by bending a vertical plate-like member forward substantially at a right angle to define an L-shape. The upper surface of a part of the mating terminal 90 facing the electrical contact member 50 is struck from a lower side to form the mating contact points 93 extending in the front-rear direction. Two mating contact points 93 form projecting beads, and are disposed to be accommodated in a diameter circle of the coil spring 40 in a plan view when the connector 15 and the mating connector C are connected.

Further, the mating terminal 90 is held in the mating housing 95 by insert molding. The mating housing 95 is provided with the fitting 97 that can enter the housing opening 85, and the mating terminal 90 is held in the fitting 97. A flange 99 projects out at the lower edge of the fitting 97. The flange 99 contact the lower surface of the connector housing 80 to suppress the entrance of the mating terminal 90 beyond a specified position.

As shown in FIG. 1, a spring receiving portion 26 for receiving the upper end of the coil spring 40 is provided on an upper part of the case 20. The spring receiving portion 26 is constituted by the ceiling wall 21, the side walls 23 and two retaining pieces 24. The retaining pieces 24 are on two peripheral edges of the ceiling wall 21 that are not provided with the side walls 23. The retaining piece 24 is composed of a base 24A and a flat surface 24B. The base 24A bulges outward of the case 20 from the peripheral edge of the ceiling wall 21 by being disposed between two cutouts 22 provided on the peripheral edge of the ceiling wall 21. The flat surface 24B extends straight toward the bottom wall 51 after being inclined inwardly of the case 20 from the base 24A. The flat surface 24B of the retaining piece 24 constitutes the spring receiving portion 26 for receiving a side part of the coil spring 40.

The bottom wall 51 constitutes the electrical contact 50 to be connected electrically to the mating contact points 93, and is movable between an initial position (FIG. 2) where the bottom wall 51 is supported by the wide portions 25B of the front walls 25 and the contact portions 31 and a connection position (FIG. 9) where the bottom wall 51 is displaced toward the ceiling wall 21 by being connected to the mating contact points 93. The bottom wall 51 at the connection position is disposed below the projecting ends (lower ends) of the retaining pieces 24. Thus, when the bottom wall 51 reaches the connection position from the initial position as the connector 15 and the mating connector C are connected, the bottom wall 51 does not interfere with the projecting ends of the retaining pieces 24.*b*

Figure 8:
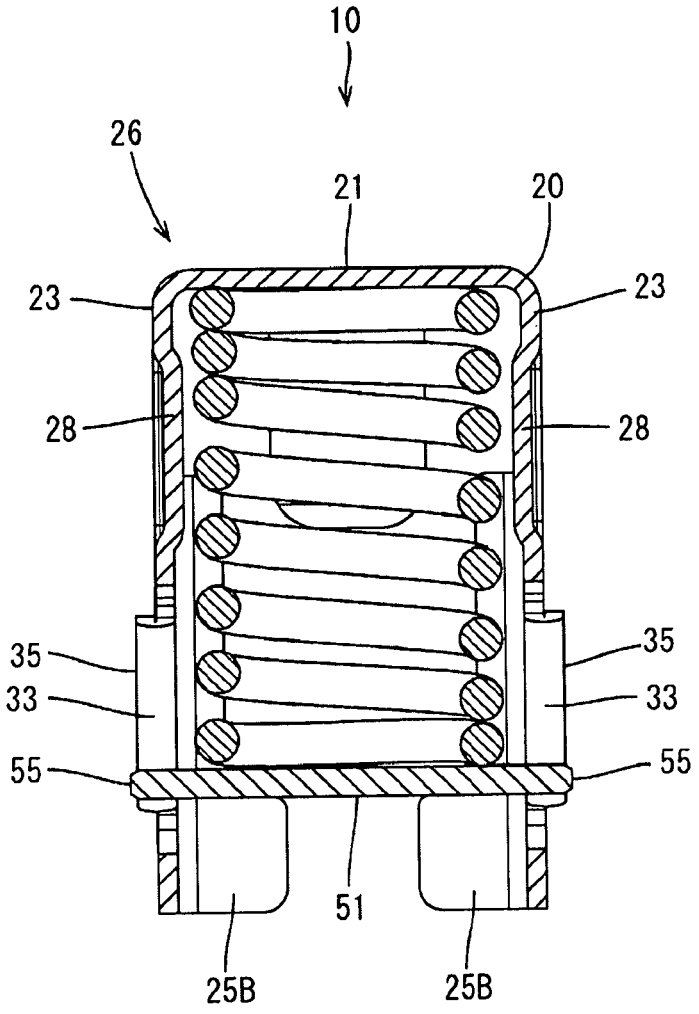
FIG. 8 is a section along B-B in FIG. 3.
Figure 9:
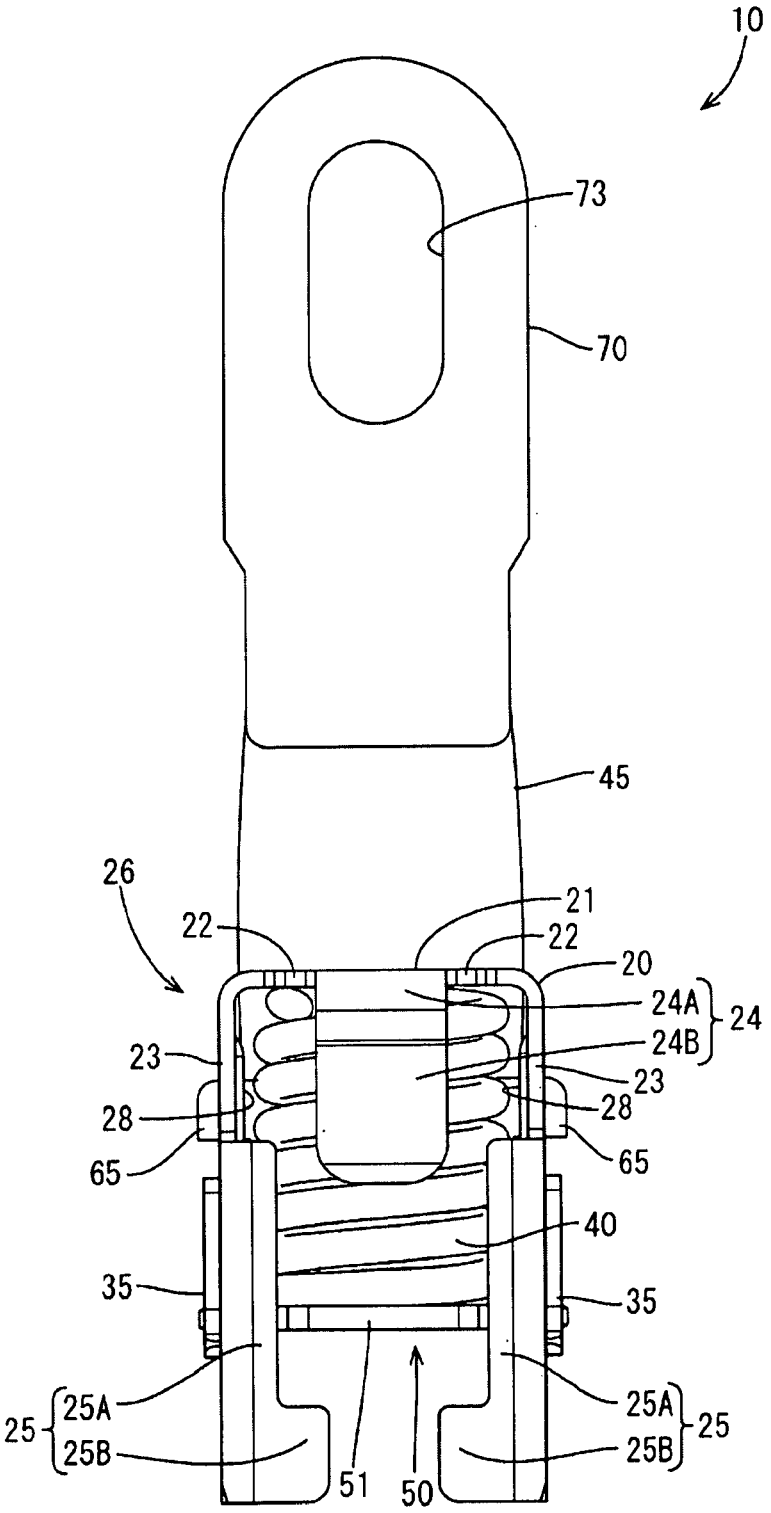
FIG. 9 is a front view of the terminal module in which a bottom wall is at a connection position.

The side wall 23 includes a struck portion 28 formed by striking the case 20 inwardly. This struck portion 28 constitutes the spring receiving portion for receiving a side part of the coil spring 40. The struck portions 28 and the flat surfaces 24B of the retaining pieces 24 are disposed substantially at the same height in the vertical direction as shown in FIG. 2. As shown in FIG. 7, a clearance between the flat surface 24B of the retaining piece 24 and the side part of the coil spring 40 is set at about 0.5 mm. Further, as shown in FIG. 8, a clearance between the struck portion 28 and the side part of the coil spring 40 also is set at about 0.5 mm.

As shown in FIG. 7, the interference of the connecting piece 61 of the electrical contact member 50 and the retaining piece 24 can be avoided by inclining the flat surface 24B of the retaining piece 24 on a shown right side inwardly of the case 20. If a retaining piece is provided to extend directly downward from the base end portion 24A, a displacement amount of the electrical contact member 50 in the front-rear direction needs to be reduced by making the gradient of the folded portions 35 of the guide portions 33 smaller to avoid the interference of the connecting piece 61 of the electrical contact member 50 and the retaining piece. However, a sufficient displacement amount of the electrical contact member 50 in the front-rear direction by the guide portions 33 can be ensured by providing the retaining pieces 24 with the flat surface portions 24B.

This embodiment is configured as described above. Next, functions of this embodiment are described. First, the fitting 97 of the mating connector C is fit into the housing opening 85 of the connector 15 and the opening 27 of the case 20 from below, as shown in FIG. 10, to connect the mating connector C to the connector 15. Then, the mating contact points 93 of the mating terminal 90 start coming into contact with the lower surface of the bottom wall 51 of the electrical contact member 50. If the fitting 97 of the mating connector C continues to be fit into the opening 27 of the case 20, the electrical contact member 50 is lifted upward by the mating contact points 93 and the coil spring 40 are compressed farther. At that time, since the second protruding portions 55 of the bottom wall 51 are guided obliquely upward by the guides 33, the lower surface (contact point) of the bottom wall 51 and the mating contact points 93 slide against each other in the front-rear direction to remove external matter between the contact points.

Figure 11:
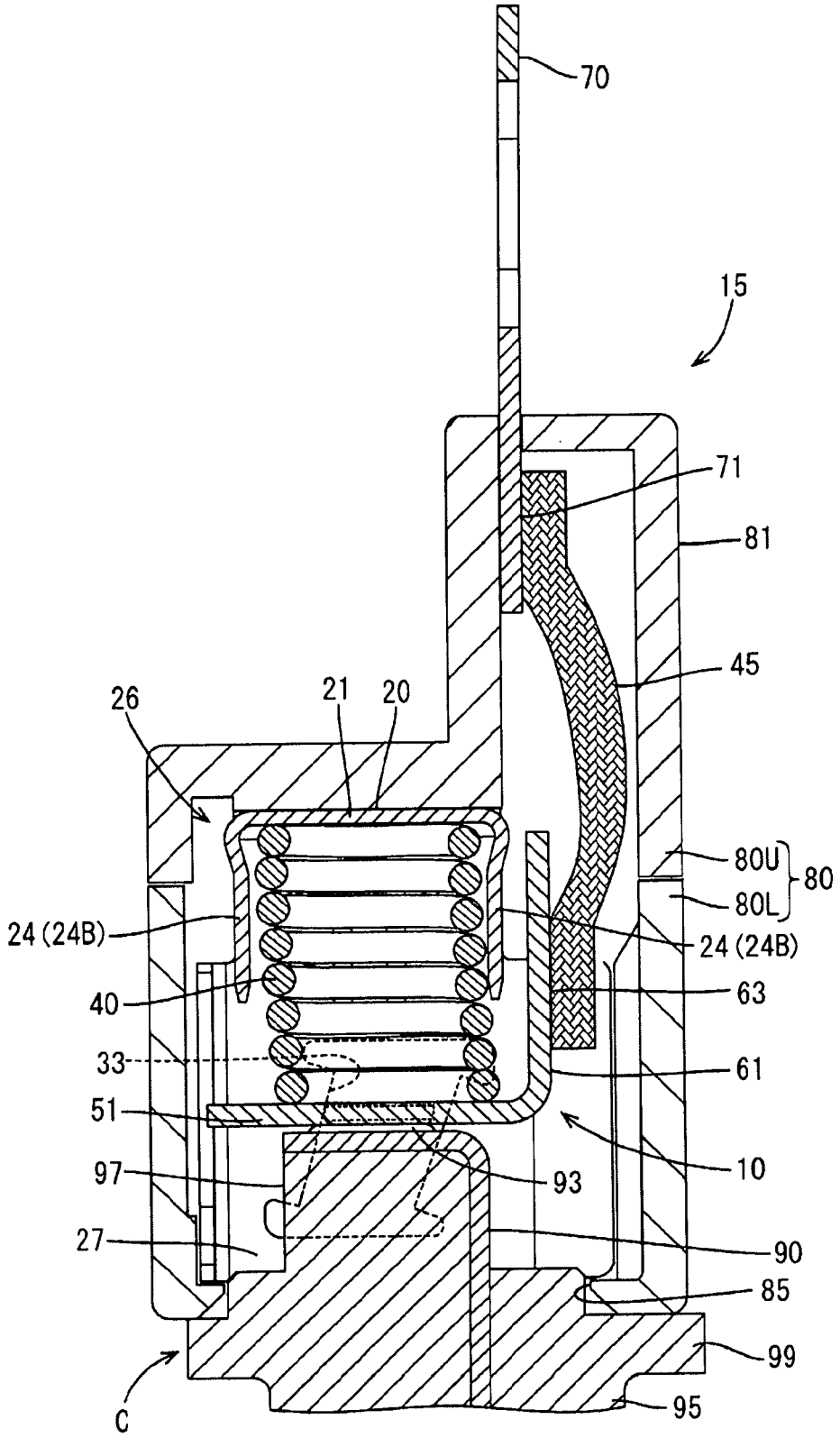
FIG. 11 is a section showing a state after the connector is connected to the mating connector.

If the connection of the mating connector C and the connector 15 is completed in this way, the flange 99 contacts an opening edge part of the housing opening 85 and the intermediate part 49 of the braided wire 45 is deflected and deformed, as shown in FIG. 11. Further, the lower part of the coil spring 40 is shifted somewhat rearward according to a movement of the bottom wall 51. However, the side part of the coil spring 40 contacts the flat surface 24B, thereby suppressing an excessively inclined posture of the coil spring 40. Thus, a contact pressure is not reduced due to a reduction in the biasing force of the coil spring 40, and the electrical contact 50 and the mating terminal 90 are connected electrically with a sufficient contact pressure.

As described above, since the case 20 made of metal is provided with the spring receiving portion 26 for receiving the end part of the coil spring 40 according to the terminal module 10 of this embodiment, the spring receiving portion 26 is not deformed or broken by being pressed by the coil spring 40 and the terminal module 10 can be applied when a large current is used.

A method for fixing a guiding bar to a ceiling wall of a case and inserting the guiding bar into the coil spring 40 might be adopted for supporting the coil spring 40. However, costs of the guiding bar and crimping cost for crimping and fixing the guiding bar to the case are incurred, and the cost of a terminal module increases. However, the above-described terminal module 10 avoids the component cost of the guiding bar and processing cost for fixing the guiding bar to the case.

The bottom wall 51 may constitute the electrical contact member 50 to be connected electrically to the mating contact points 93 and may be movable between the initial position where the bottom wall 51 is supported by supporting portions (wide portions 25B and contact portions 31) provided on the two side walls 23 and the connection position where the bottom wall 51 is displaced toward the ceiling wall 21 by being connected to the mating contact points 93. Additionally, the bottom wall 51 at the connection position may be closer to the supporting portions than the projecting ends of the retaining pieces 24. According to this configuration, when the bottom wall 51 is connected electrically to the mating contact points 93, the bottom wall 51 is displaced from the initial position toward the ceiling wall 21 to reach the connection position. However, since the bottom wall 51 is closer to the supports than the projecting ends of the retaining pieces 24, the bottom wall 51 does not interfere with the projecting ends of the retaining pieces 24.

The retaining piece 24 may be composed of the base end 24A bulging outwardly of the case 20 from the periphery of the ceiling wall 21 by being disposed between the two cutouts 22 on the periphery of the ceiling wall 21 and the flat surface 24B extending straight from the base 24A toward the bottom wall 51 and constituting the spring receiving portion 26. According to this configuration, the clearance formed between the coil spring 40 and the retaining piece 24 can be made smaller as compared to the case where the retaining piece 24 is not provided with the flat surface 24B.

The side wall 23 may include the struck portion 28 formed by being struck inwardly of the case 20 and constituting the spring receiving portion 26. According to this configuration, the clearance formed between the coil spring 40 and the side wall 23 can be made smaller as compared to the case where the side wall 23 is not provided with the struck portion 28.

The invention is not limited to the above described and illustrated embodiment. For example, the following various modes also are included.

Although the bottom wall 51 at the connection position is disposed below the lower ends of the retaining pieces 24 in the above embodiment, the bottom wall may be provided with escaping holes and the retaining pieces 24 may be inserted into the escaping holes.

Although the flat surfaces 24B of the front and rear retaining pieces 24 are inclined inwardly of the case 20 in the above embodiment, the flat surface portion of the retaining piece on a left side in FIG. 11 may be disposed outside the case 20.

Although the side wall 23 has the struck portion 28 in the above embodiment, a flexible piece may be provided by folding a part of the side wall 23.

Although the bead-like projecting mating contact points 93 are illustrated in the above embodiment, a plurality of spherically projecting mating contact points may be provided.

LIST OF REFERENCE SIGNS

10 . . . terminal module
20 . . . case
21 . . . ceiling wall
22 . . . cutout
23 . . . side wall
24 . . . retaining piece
24A . . . base
24B . . . flat surface
25 . . . front wall
25B . . . wide portion (support)
26 . . . spring receiving portion
28 . . . struck portion
31 . . . contact portion (support)
40 . . . coil spring
50 . . . electrical contact
51 . . . bottom wall
93 . . . mating contact point

What is claimed is:

1. A terminal module, comprising:

a metal case having a ceiling wall, opposed first and second side walls projecting from opposite first and second sides of the ceiling wall and facing one another, and front and rear retaining pieces projecting from opposite front and rear ends of the ceiling wall and facing one another in a direction perpendicular to a facing direction of the side walls so that the side walls and the retaining pieces are arranged alternately around a periphery of the ceiling wall, a spring receiving space being defined adjacent the ceiling wall and between the side walls and the retaining pieces;

an electrical contact disposed between the side walls and opposed to the ceiling wall, a surface of the electrical contact facing away from the ceiling wall being connectable to a mating contact, the electrical contact being movable between a first position and a second position that is closer to the ceiling wall than the first position;

a metal coil spring having a top end disposed in the spring receiving space and a bottom end engaged with the electrical contact so that the coil spring is sandwiched between the ceiling wall and the electrical contact; and the side walls have supports that support the electrical contact when the electrical contact is in the first position and the electrical contact moves from the first position to the second position when the terminal module is connected to the mating contact.

2. The terminal module of claim 1, wherein the front and rear retaining pieces face one another in a first direction, and the electrical contact undergoes a movement parallel to the first direction while the electrical contact is moving from the first position to the second position.

3. The terminal module of claim 2, wherein:

each of the first and second side walls has a guide portion for linearly guiding a movement of the electrical contact between the first and second positions.

4. The terminal module of claim 1, wherein:

each of the first and second side walls has a guide portion for linearly guiding a movement of the electrical contact between the first and second positions.

5. The terminal module of claim 1, further comprising:

an external connecting member disposed outside the metal case; and a braided metal wire having a first end electrically connected to the electrical contact and a second end connected to the external connecting member, wherein the braided wire is flexible and deformable in response to movement of the electrical contact.

6. A connector comprising:

the terminal module of claim 1; and a housing covering the metal case, the housing having an opening disposed to enable the mating contact to contact the surface of the electrical contact opposite the ceiling wall and to move the electrical contact from the first position to the second position in the metal case.

7. A connector assembly, comprising:

the connector of claim 6; and a mating connector having the mating contact.

* * * * *